United States Patent [19]

Matsushima et al.

[11] 4,110,129

[45] Aug. 29, 1978

[54] POST TREATMENT OF CONVERSION-COATED ZINC SURFACES

[75] Inventors: Yasunobu Matsushima, Kawasaki; Kuniji Yashiro, Yokohama; Hideaki Kaneko; Masanori Suzuki, both of Tokyo, all of Japan

[73] Assignee: Oxy Metal Industries Corporation, Warren, Mich.

[21] Appl. No.: 765,335

[22] Filed: Feb. 3, 1977

[51] Int. Cl.[2] ..... C23F 7/12

[52] U.S. Cl. ..... 148/6.15 R; 148/6.14 R

[58] Field of Search ..... 148/6.15 R, 6.15 Z, 148/6.16, 6.14 R

[56] References Cited

U.S. PATENT DOCUMENTS

| | | | |
|---|---|---|---|
| 3,101,286 | 8/1963 | Reinhold | 148/6.15 Z |
| 3,682,713 | 8/1972 | Ries et al. | 148/6.15 R |
| 3,895,970 | 7/1975 | Blum et al. | 148/6.15 R |
| 3,975,214 | 8/1976 | Kulick et al. | 148/6.15 R |

*Primary Examiner*—Ralph S. Kendall

*Attorney, Agent, or Firm*—Arthur E. Kluegel; Richard P. Mueller; Bertram F. Claeboe

[57] ABSTRACT

Disclosed is a process wherein a conversion coated zinc or zinc alloy surface is post-treated with an aqueous solution comprising at least 0.02 g/l titanium ion and at least 0.1 g/l of an adjuvant selected from phosphoric acid, phytic acid, tannin, the salts and esters of the foregoing, and hydrogen peroxide.

7 Claims, No Drawings

POST TREATMENT OF CONVERSION-COATED ZINC SURFACES

BACKGROUND OF THE INVENTION

The present invention relates to the art of post-treating conversion-coated zinc or zinc alloy surfaces to improve the corrosion resistance, paint receptivity and other qualities of the surface. More specifically, it relates to the art of accomplishing the foregoing without employing objectionable chromium chemicals.

Zinc and zinc alloys have been conventionally applied to steel surfaces by the electroplating or hot galvanizing process in order to improve corrosion resistance. The galvanized steel plate prepared by such methods have been conversion coated (e.g., chromated or phosphated) and/or oiled to further enhance corrosion resistance. There are also galvanized steel plates which have been first phosphated, compound oxide coated (e.g., See U.S. Pat. Nos. 2,762,733 and 2,849,344), or chromated and then painted and cured.

Chromates are conventionally employed not only in the chromating process but as post-treatments in the phosphating and compound oxide coating processes. The anti-corrosion effect of the chromating treatment on metals, especially on steel, zinc or aluminum is outstanding and consequently chromates have been widely employed in the field of metal surface treatment. Nevertheless, the environmental and health hazards of the toxic chromium compounds have come into question, and it has become an objective to develop safer surface treating agents which can be employed in place of chromium.

Various studies have been made concerning treating compositions containing no chromates. Processes for treating metal or conversion coated metal surfaces with compositions containing mainly phytic acid are suggested in Japanese patent publication Nos. 23462/1963, 11006/1969, 21566/1970 and 43406/1973 and Prepublished Japanese patent application No. 104845/1974. Treating with compositions containing mainly alphaaminophosphonic acid or alphaaminophosphonous acid is suggested in Prepublished Japanese patent application No. 78531/1975, and treating with compositions containing mainly tannic acid is suggested in Prepublished Japanese patent application No. 47224/1974. Such processes, however, are unsatisfactory when employed for practical uses on zinc or alloys thereof.

The following are conventional treatment cycles:

(1) Phosphating
- (a) Hot galvanized plates
  - (i) Wet buffing if the surface has been chromated.
  - (ii) Hot water rinse.
  - (iii) Surface conditioning with colloidal titanium phosphate
  - (iv) Phosphating
  - (v) Hot water rinse.
  - (vi) Post treatment.
  - (vii) Dry.
- (b) Electrogavanized plates
  - (i) Cleaning with a weak alkali (this alkali often contains colloidal titanium phosphate to effect concurrently the surface conditioning)
  - (ii) Hot water rinse.
  - (iii) Phosphating
  - (iv) Hot water rinse.
  - (v) Post-treatment.
  - (vi) Dry.

(2) Compound oxide coating process:
- (i) Alkali cleaning.
- (ii) Wet buffing if the surface has been chromated.
- (iii) Hot water rinse.
- (iv) Compound oxide formation.
- (v) Hot water rinse.
- (vi) Post-treatment
- (vii) Dry.

SUMMARY OF THE INVENTION

It has now been discovered that the chromium-free post-treatment of conversion coated zinc or zinc alloy surfaces may be accomplished by contacting the surface with an aqueous solution containing titanium ion and at least one adjuvant compound selected from the group consisting of phosphoric acid, phytic acid, tannin, the salts and esters of the foregoing, and hydrogen peroxide. The aqueous solution contains at least 0.02 g/l of titanium ion, from at least 0.1 g/l of the adjuvant and is adjusted to a pH value from about 2 to about 6.

DETAILED DESCRIPTION OF THE INVENTION

The treatment according to the present invention is carried out by contacting the conversion coated galvanized steel surface with an aqueous composition which contains titanium ion in an amount of at least 0.02 g/l, preferably less than 5 g/l and most preferably from 0.05 to 2.5 g/l and one or more adjuvants selected from the group consisting of phosphoric acid, phytic acid, tannin, the salts or esters of the foregoing and hydrogen peroxide in an amount of at least 0.1 g/l, preferably less than 10 g/l, and most preferably from 0.2 to 5 g/l and having a pH of about 2–6. Contact may be accomplished by any conventional technique such as spraying, immersion, brushing or roll coating at a temperature from room temperature to 90° C, preferably from room temperature to 65° C, followed by drying without washing the treated surface with cold or hot water.

The surface thus treated according to the present invention is then coated with a paint and baked to provide colored galvanized steel plates in Process 1)-(a) or 2). It has been found that the treatments according to these processes pass the salt spray test as specified in JIS-G-3312 with results comparable to conventional chromating treatments and show no significant change in the test for a longer period of time than the specified time in the standard, thus demonstrating a marked improvement in the corrosion resistance of the painted steel plates. On the other hand, when galvanized steel plates have been treated with single component employed in the present process or contained in the water-soluble compositions of the present invention, such as titanium ion, phosphoric acid, phytic acid, tannin or hydrogen peroxide exclusively, or have been water rinsed in place of the post-treatment step, most of the painted plates will not pass the salt spray test according to JIS-G-3312 and the portion of the plates which passed the test showed development of blisters or increased width of creep from the cross-cut portions or like defects when subjected to the test for a longer period of time than the specified time.

The steel plates treated by Process 1)-(b) remain unpainted and are marketed as such. Electrogalvanized plates are painted by the purchaser. Hence the plates should have bare corrosion resistance until they have been coated with a paint. The unpainted plates treated according to the process of the present invention (Process 1)-(b) ) take from 6 to 16 hours before white stains develop on the surface in the salt spray test according to JIS-Z-2371 which is comparable to those treated with conventional chromating processes. On the other hand, when the steel plates have been treated with a single component employed in the process of the present invention such as titanium ion, phosphoric acid, phytic acid, tannin or hydrogen peroxide exclusively or have been water rinsed in place of the post-treatment step, the unpainted plates take only 1 to 4 hours except that those treated with phytic acid take 8 hours until white stains are developed in the salt spray test according to JIS-Z-2371.

From the foregoing experimentations, it has been found to be possible only by treating the chemically converted surface of zinc or alloys thereof with a water-soluble composition containing titanium ion and one or more members selected from the group comprising phosphoric acid, phytic acid, tannin, their salts or esters and hydrogen peroxide to provide improved corrosion resistance of the surface.

Titanium ion usable in the present invention may be supplied in the form of a soluble compound such as titanium fluoride, titanium ammonium fluoride, titanium lithium fluoride, titanium sodium fluoride, titanium potassium, fluoride, potassium titanyl oxalate or titanyl sulfate and the like.

If the water-soluble compositions according to the present invention contain titanium ion in a concentration of less than 0.02 g/l, no corrosion resistance will be imparted on the surface. The effect on the corrosion effect cannot be improved at a concentration of higher than 5 g/l so that titanium ion at a concentration of higher than 5 g/l will be economically disadvantageous.

Phosphoric acid usable in the present invention may include, for example, from 75 to 85% orthophosphoric acid, ammonium dihydrogen phosphate, ammonium hydrogen phosphate, sodium dihydrogen phosphate, sodium hydrogen phosphate, potassium dihydrogen phosphate, potassium hydrogen phosphate. Polyphosphate such as potassium pyrophosphate, sodium tripolyphosphate and the like may be used. However, since the composition of the present invention has a pH value ranging from 2 to 6, pyrophosphoric acid and tripolyphosphoric acid will be hydrolyzed eventually into orthophosphoric acid so that it is advantageous in the practice to use orthophosphoric acid or a salt thereof.

Phytic acid and tannin may be supplied in any soluble form. Phytic acid may suitably be supplied as a 50% or 70% aqueous solution of phytic acid. As tannin, Chinese gallotannin (tannic acid) or quebracho extract is preferred but other vegetable tannins may be employed.

As a source of hydrogen peroxide, commercially available 35% aqueous solutions are most convenient. It is also possible to supply hydrogen peroxide from a compound such as sodium perborate, peroxyphosphoric acid or other peroxy compounds which liberate hydrogen peroxide in aqueous solution.

The present invention will be now illustrated by way of the following examples.

EXAMPLES 1 to 10

Sealing Treatment for Colored Galvanized Steel Plates

Specimens were of hot-galvanized steel plate (zero-spangled chromated plate available from Shin Nittetsu Co.) having a size of 100 × 200 × 0.27 mm and having been processed as a base for a colored galvanized steel plate. The specimens were polished by passing them through a wet buffing machine in 3 passes to scrape the chromate film, followed by rinsing with hot water for 3 seconds. The specimens were then contacted with aqueous cleaning solution at 40° C by spraying for 3 seconds. Immediately thereafter, the specimens were treated with a conventional phosphating bath for colored galvanized steel at 65° C for 10 seconds by the spraying process, followed by rinsing with hot water at 40° C for 6 seconds. The phosphated test pieces were sprayed with one of the watersoluble compositions according to the present invention as specified in Examples 1 to 10 and those of Comparative Examples 1 to 8 in Table 1 at 40° C for 3 seconds. The treated test pieces were then passed through electrically driven rubber rolls to remove the excess water-soluble composition, dried in hot air at 120° C and then allowed to stand until they were cooled to a temperature of lower than 40° C. The thus-treated specimens were coated with paint (an alkyd resin type available from Nippon Paint Co.) by means of a coater No. 12 and the coated paint was baked by heating the specimens to a temperature of 210° C to obtain a coating thickness of 7 microns. The edges of the specimens were seal-painted with a ship bottom coating (Silver VSI available from Takada Toryo Co.). The specimens were cross-hatched on the lower half thereof by means of a NT cutter and subjected to the salt spray test according to JIS-Z-2371 for 240 hours. The test pieces were then rinsed with water and dried. Scotch tapes having a width of 50 mm were applied to the cross-hatched portion and the flat portion (the upper half of test pieces without the cross-hatch) and tightly adhered on the surfaces by means of a rubber roller. One minute thereafter, the tapes were stripped off rapidly and the peeled width in mm at both sides of the cross-hatch and the number of blisters on the flat portion were observed. Table 4 shows the results evaluated in accordance with the evaluation criteria specified in Tables 2 and 3.

Table 1

| | Composition of treating solution, g/l | | | | | | | | |
|---|---|---|---|---|---|---|---|---|---|
| Example | $(NH_4)_2TiF_6$ | $K_2TiO(C_2O_4) \cdot 2H_2O$ | $H_2TiF_6$ | $H_2O_2$ (100%) | $NH_4H_2PO_4$ | Phytic acid (100%) | Tannic acid | Chromate Solution | Remarks |
| 1 | 3 | | | 1.5 | | | | | |
| 2 | 3 | | | 1.5 | 1 | | | | |
| 3 | 3 | | | 1.5 | 3 | | | | |
| 4 | 3 | | | | | 0.5 | | | pH adjusted by $NH_4OH$ |
| 5 | 1 | | | | | 1 | | | " |
| 6 | | 6 | | 1.5 | | 0.5 | | | " |
| 7 | | 2 | | 0.5 | | 1 | | | " |
| 8 | | | 3 | | | 0.5 | | | |
| 9 | 3 | | | | | | 0.5 | | Available from Fuji Kagaku Co. |
| 10 | 3 | | | 1.5 | | | 1 | | " |
| Comparative | | | | | | | | | |

Table 1-continued

| Example | Composition of treating solution, g/l | | | | | | | |
|---|---|---|---|---|---|---|---|---|
| 1 | | | | | | | 20 | |
| 2 | | | | | | | | Treated only with pure water |
| 3 | | | | 1.5 | | | | |
| 4 | 3 | | | | | | | |
| 5 | | 6 | | | | | | pH adjusted by $H_2C_2O_4$ |
| 6 | | | | | 3 | | | |
| 7 | | | | | | 1 | | pH adjusted by $NH_4OH$ |
| 8 | | | | | | | 1 | |

Table 2

| Criterion for the evaluation of cross-hatched portion | |
|---|---|
| Stripped width from both sides of cross-hatch (mm) | Rating |
| 0 | 5 |
| 0.5 - 1 | 4 |
| 2 - 3 | 3 |
| 4 - 5 | 2 |
| Wider than 6 | 1 |

Table 3

| Criterion for the evaluation of flat portion | |
|---|---|
| Appearance | Rating |
| No Peeling | 5 |
| Peeling of very few spots (less than 1% of the total area) | 4 |
| Peeling of spots (2 - 10% of the total area) | 3 |
| Partial peeling (11 - 50% of the total area) | 2 |
| Severe peeling (More than 51% of the total area) | 1 |

Table 4

| Result of the Salt-Spray test for 240 hours For Painted Specimens | | | | | | | |
|---|---|---|---|---|---|---|---|
| Example | pH | Cross-Hatched portion | | | Flat Portion | | |
| 1 | 3.0 | 4 | 4 | 4 | 4 | 4 | 5 |
| 2 | 3.2 | 5 | 5 | 5 | 5 | 5 | 5 |
| 3 | 3.3 | 4 | 4 | 4 | 5 | 5 | 5 |
| 4 | 3.3 | 3 | 3 | 3 | 5 | 4 | 4 |
| 5 | 3.2 | 5 | 5 | 4 | 5 | 5 | 5 |
| 6 | 4.8 | 4 | 4 | 4 | 4 | 4 | 5 |
| 7 | 4.0 | 4 | 5 | 5 | 4 | 5 | 5 |
| 8 | 2.4 | 5 | 5 | 5 | 5 | 5 | 5 |
| 9 | 4.0 | 4 | 4 | 4 | 5 | 5 | 4 |
| 10 | 4.1 | 4 | 5 | 5 | 5 | 5 | 5 |
| Comparative Example | | | | | | | |
| 1 | 3.9 | 5 | 5 | 5 | 5 | 5 | 5 |
| 2 | 6.5 | 2 | 2 | 2 | 2 | 2 | 2 |
| 3 | 6.4 | 3 | 3 | 3 | 2 | 2 | 2 |
| 4 | 3.6 | 2 | 2 | 2 | 1 | 2 | 2 |
| 5 | 4.5 | 3 | 3 | 3 | 3 | 3 | 3 |
| 6 | 4.1 | 2 | 2 | 2 | 2 | 3 | 3 |
| 7 | 3.4 | 1 | 1 | 2 | 2 | 1 | 2 |
| 8 | 5.0 | 3 | 3 | 3 | 3 | 3 | 3 |

EXAMPLES 11 to 20

Bare Corrosion Resistance

Specimens were electrogalvanized steel plates having a coated zinc amount of 15 g/m$^2$ and a size of 100 × 200 × 0.8 mm (available from Nippon Kokan Co.). The test pieces were sprayed with a weak alkaline cleaner at 60° C for 3 seconds and then rinsed with hot water at 40° C for 6 seconds. Immediately thereafter, the test pieces were sprayed with a conventional phosphating solution for 6 seconds and then rinsed again with hot water at 40° C for 6 seconds. Then, separate specimens were sprayed with compositions specified in Examples 11 to 20 and Comparative Examples 9 to 16 at 40° C for 3 seconds passed through electrically driven rubber rolls to exclude water-soluble composition, followed by drying at 120° C with hot air. The post-treatment compositions of Examples 11–20 and Comparative Examples 9–16 correspond to those of Examples 1–10 and Comparative Examples 1–8 respectively except for Comparative Example 9 where 8.4 g/l of a different conventional chromate solution was employed.

The treated unpainted specimens were subjected to the salt spray test according to JIS-Z-2371 until white stains developed on the surface by observing the test pieces once hourly for the initial 4 hours and then once each 2 hours. The results are shown in Table 5. Triplicate specimens were employed for each composition and average results reported.

TABLE 5

| SALT SPRAY TEST ON UNPAINTED SPECIMENS | | |
|---|---|---|
| Example | pH | Development of White Stains (Hours) |
| 11 | 3.0 | 7 |
| 12 | 3.2 | 7 |
| 13 | 3.3 | 9 |
| 14 | 3.3 | 9 |
| 15 | 3.2 | 13 |
| 16 | 4.8 | 6 |
| 17 | 4.0 | 9 |
| 18 | 2.4 | 7 |
| 19 | 4.0 | 11 |
| 20 | 4.1 | 11 |
| Comparative Example | | |
| 9 | 2.1 | 11 |
| 10 | 6.5 | 1 |
| 11 | 6.4 | 1 |
| 12 | 3.6 | 3 |
| 13 | 4.5 | 2 |
| 14 | 4.1 | 2 |
| 15 | 3.4 | 7 |
| 16 | 5.0 | 4 |

We claim:

1. A chromium-free process for treating an oxide or phosphate conversion coated zinc or zinc alloy surface comprising contacting the surface with an aqueous post-treatment solution comprising at least 0.02 g/l of titanium ion and at least 0.1 g/l of at least one adjuvant selected from the group consisting of phosphoric acid, phytic acid, tannin, the salts or esters of the foregoing and hydrogen peroxide.

2. The process of claim 1 wherein the post-treatment solution is adjusted to a pH value in the range of about 2 to 6.

3. The process of claim 1 wherein the surface is subsequently painted.

4. The process of claim 1 wherein the titanium ion concentration in the post-treatment solution is not in excess of 5 g/l.

5. The process of claim 4 wherein the titanium concentration is between 0.05 and 2.5 g/l.

6. The process of claim 1 wherein the adjuvant concentration in the post-treatment solution is not in excess of 10 g/l.

7. The process of claim 6 wherein the adjuvant concentration is between 0.2 and 5 g/l.

* * * * *